United States Patent [19]

Foulletier et al.

[11] 3,941,705

[45] Mar. 2, 1976

[54] FIRE EXTINGUISHING COMPOSITIONS CONTAINING FLUORINATED SURFACTANTS

[75] Inventors: Louis Foulletier, Oullins; Rene Bertocchio, St. Genis-Laval, both of France

[73] Assignee: Produits Chimiques Ugine Kuhlmann, Paris, France

[22] Filed: Mar. 18, 1975

[21] Appl. No.: 559,565

Related U.S. Application Data

[63] Continuation of Ser. No. 361,135, May 17, 1973, abandoned.

[30] Foreign Application Priority Data

May 23, 1972 France ..... 72.18242

[52] U.S. Cl. ..... 252/8.05; 21/605 A; 252/356

[51] Int. Cl.[2] ..... A62D 1/00

[58] Field of Search ..... 252/8.05, 3, 356

[56] References Cited

UNITED STATES PATENTS

| | | | |
|---|---|---|---|
| 3,661,776 | 5/1972 | Fletcher et al. | 252/3 |
| 3,772,195 | 11/1973 | Francen | 252/8.05 |

FOREIGN PATENTS OR APPLICATIONS

| | | | |
|---|---|---|---|
| 466,280 | 2/1971 | Japan | 252/3 |

*Primary Examiner*—Benjamin R. Padgett
*Assistant Examiner*—David Leland
*Attorney, Agent, or Firm*—Pennie & Edmonds

[57] ABSTRACT

A surface-active fluorinated composition characterized by the association therein of from 35% to about 60% of at least one surface-active ampholyte compound of the formula

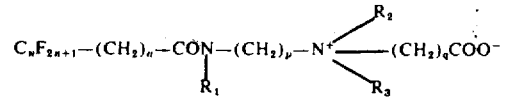

wherein $n$ is an integer between 1 and 20, $a$ is a number between 2 and 10, $R_1$ is an atom of hydrogen or an alkyl radical containing from 1 to 6 atoms of carbon, $R_2$ and $R_3$ are alkyl radicals containing from 1 to 3 atoms of carbon, at least one of which is the methyl radical and $p$ and $q$ are integers between 0 and 10; from about 20% to about 40% of at least one surface-active fluorinated non-ionic compound of the formula $$C_nF_{2n+1}-(CH_2)_a-CO-O-(CH_2-CH_2-O)_mR_4$$

wherein $n$ and $a$ have the same meaning as above, $m$ is an integer between 1 and 20 and $R_4$ is an alkyl radical containing from 1 to 6 atoms of carbon; and from about 8% to about 40% of at least one amine salt compound of the formula

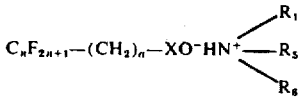

wherein X is the group CO or $SO_2$, $R_1$, $R_5$ and $R_6$ may be hydrogen atoms, alkyl radicals containing from 1 to 6 atoms of carbon, or the group

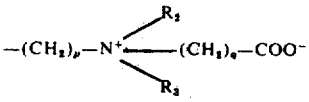

in which $R_2$, $R_3$, $p$ and $q$ have the values given above.

20 Claims, No Drawings

FIRE EXTINGUISHING COMPOSITIONS CONTAINING FLUORINATED SURFACTANTS

This is a continuation of application Ser. No. 361,135 filed May 17, 1973, now abandoned.

BACKGROUND OF THE INVENTION

1. Field of the Invention

The present invention pertains to a composition of superactive fluorocarbonated products useful as bases or starting materials for the manufacture of fire extinguishing mixtures and having particular utility in combating hydrocarbon fires.

2. Description of the Prior Art

The efficacy of the compositions of the present invention as fire extinguishing agents depends essentially on their film-forming properties and on the solidity or strength of the films produced. It is moreover additionally advantageous that these solutions have good foaming properties, since the most commonly employed method of combating fire comprises projecting the solution at the base of the fire in the form of a foam. Unfortunately, the foam itself does not resist the heat radiated from adjacent localities or parts of the fire as well as would be desired, and the action of the foam should be supplemented by the formation of a film which is impermeable to the vapors [products of combustion] and resulting from spreading of the solution. The film actually consists of a colloidal fluorinated membrane which adheres to the surface of the hydrocarbon and which supports a liquid film of the aqueous surface-active solution, according to the principle which is well known under the name of "light water" and which is described in U.S. Pat. No. 3,258,423.

The film has several functions, first it isolates the combustible material from the oxygen of the atmosphere, further since it releases water vapor directly at the base of the flames it thereby retards combustion, and finally it functions as a thermal screen, that is as an insulator, between the combustible material and the vapors that are already in the process of burning.

It is known that a liquid, B, can spread on a liquid, A, only if the work of adhesion, $T_{AB}$, corresponding to the formation of the interface AB, is greater than the work of cohesion of the liquid B, $T_{cohB}$, which work of cohesion is equal to twice the surface tension, $X_B$. If $T_{AB}$ is replaced by the value for it in the Dupre equation and if the spreading coefficient, S, denotes the quantity $T_{AB} - T_{cohB}$, then the condition for spreading can be written as $$S = (\gamma_A + \gamma_B - \gamma_{AB}) - 2\gamma_B > 0,$$

wherein $\gamma_{AB}$ is the interfacial tension between the liquids A and B, i.e.

$$S = \gamma_A - (\gamma_B + \gamma_{AB}) > 0$$

These quantities are directly determinable from experimentation and conequently it is possible to predict the behavior of the two immiscible liquids in presence of each other.

The above formulae show that the spreading properties of the aqueous surface-active solutions will be inversely related to their surface tension and to their interfacial tension with respect to the hydrocarbon. The interfacial tension is determined by the molecular structure of the compounds and the polar interactions which can result therefrom, and has only a small effect on aliphatic hydrocarbons.

The surface tension of an aqueous solution can be reduced by increasing the concentration of the surface-active agent, however, there is a limit to achieving a reduction in this manner, due to the critical micellar concentration beyond which it is not possible to obtain a decreased value.

In practice, the majority of the fluorinated surface-active compounds which are described in the literature, and particularly those cited in French patents Nos. 1,405,794 and 2,035,584, and in U.S. Pat. Nos. 2,764,602 and 3,258,423, do not permit the formation of durable films on hydrocarbons whose surface tension is lower than 22 to 23 dynes per centimeter, for example, high octane gasoline whose surface tension is 22.4 dynes/cm.

SUMMARY OF THE INVENTION

The fire extinguishing material of this invention, which are to be utilized in aqueous solution, may be made up exclusively of mixtures of the disclosed fluorinated materials or of mixtures of these materials and of proteins, optionally supplemented with other ingredients. These proteins or additives are known and described in 3M U.S. Pat. No. 3,258,423, and are substances such as, for example, keratin, albumin, globulin, hemoglobulin and cereal flours, modified by hydrolysis and stabilized with salts of polysolvent metals such as ferrous sulphate. These additives may also be dried powders, such as for example potassium bicarbonate. By virtue of their remarkable tensio-active or surface-active film-forming properties, the solutions obtained from mixtures of the disclosed fluorinated material may also find use in particular hydrocarbons as evaporation retarding agents for volatile liquid organic compounds. Protection of the free surfaces of a hydrocarbon mass by an impermeable fluorinated film substantially increases the safety of all installations where large quantities of flammable liquid organic materials are stored and handled.

Such materials are obtained by taking advantage of the conjoined actions of:

1. a surface-active fluorocarbonated ampholyte of the formula:

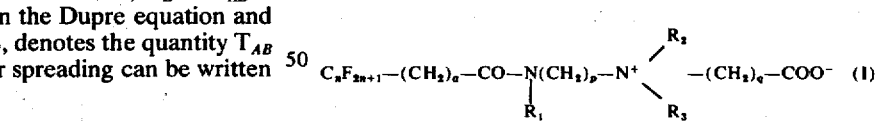

$$C_nF_{2n+1}-(CH_2)_a-CO-N(R_1)(CH_2)_p-N^+(R_2)(R_3)-(CH_2)_q-COO^- \quad (I)$$

2. anion-ionic surface-activated fluorcarbonated material of the formula:

$$C_nF_{2n+1} - (CH_2)_a - CO - O - (CH_2 - CH_2 - O)_mP_4 \quad (II)$$

and, 3. a salt of a polyfluorinated acid and an amine including at least one hydrophilic group

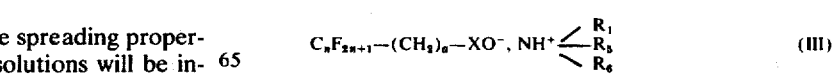

$$C_nF_{2n+1}-(CH_2)_a-XO^-, NH^+(R_1)(R_5)(R_6) \quad (III)$$

or one quaternized tertiary group of the formula:

$$C_nF_{2n+1} - (CH_2)_a - XO^-, N^+H_2R_1 - (CH_2)_pN^+(R_2R_3) - (CH_2)_q - COO^- \quad (IV)$$

The surface active fluorcarbonated ampholyte compounds of Formula I which may be used as constituents of the compositions of this invention are the products described in French Patents Nos. 2,088,699 of Dec. 13, 1971, and 2,127,287 of Sept. 18, 1972. They correspond to Formula I

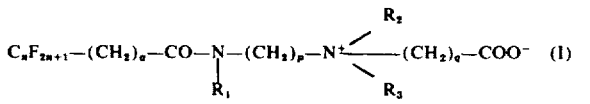

$$C_nF_{2n+1}-(CH_2)_a-CO-N(R_1)-(CH_2)_p-N^+(R_2)(R_3)-(CH_2)_q-COO^- \quad (I)$$

which contains a straight or branched perfluorinated chain, and in which $n$ is an integer between 1 and 20; a is a number between 2 and 10, $R_1$ is a hydrogen atom or an alkyl radical containing from 1 to 6 carbon atoms, $R_2$ and $R_3$ are alkyl radicals containing from 1 to 3 carbon atoms, at least one of these radicals being a methyl radical, and in which $p$ and $q$ are integers between 0 and 10.

The non-ionic surface-active fluorcarbonated compounds are products of the general formula:

$$C_nF_{2n+1} - (CH_2)_a - CO - O - (CH_2 - CH_2 - O)_m R_4 \quad (II)$$

wherein $n$ and a have the same meanings as set forth above, $m$ is an integer between 1 and 20, and $R_4$ is an alkyl radical containing from 1 to 6 carbon atoms.

These compounds are prepared by conventional esterification of the acids $C_nF_{2n+1} - (CH_2)_a$ COOH by means of polyethoxylated $\omega$-alkylated alcohols of the general formula $$HO - (CH_2 - CH_2 - O)_mR_4$$

The salts of polyfluorinated acids and of the quaternized amines of the Formula IV are obtained by the action of a lactone

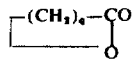

on salts of polyfluorinated acids of the formula $$C_nF_{2n+1} - (CH_2)_a - XOH$$

and diamines of the formula

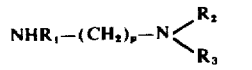

$$NHR_1-(CH_2)_p-N(R_2)(R_3)$$

in which $C_nF_{2n+1}$; $n$, $a$, $p$, $q$, $R_1$, $R_2$, and $R_3$ correspond to the definitions given above.

DESCRIPTION OF THE PREFERRED EMBODIMENTS

The applicants have found that solutions of mixtures of two fluorinated surface-active agents, one the ampholyte of Formula I and the other the non-ionic agent of Formula II, possess a surface tension which varies as a function of the proportions of the two constituents and which can in certain cases and for a given composition possess minimum values lower by several dynes per centimeter than the value possessed by solutions of the pure constituents at the same total concentration.

Table I shows by way of example the variation of the surface tension in solutions prepared from 0.5% solutions of the ampholyte surface-active agent $$C_8F_{17}C_2H_4 - CO - NH - (CH_2)_3N^+(CH_3)_2CH_2 - CH_2 - COO^- \quad (I_1)$$

and of the non-ionic surface-active compound $$C_6F_{13} - C_2H_4 - COO - (CH_2 - CH_2 - O)_7 - CH_3 \quad (II_1)$$

TABLE I

| Volumes of aqueous 0.50% solutions in cm³ | | Surface tension of the mixtures in dynes/cm at 20.5°C |
|---|---|---|
| Ampholyte fluorinated compound $I_1$ | Non-ionic fluorinated compound $II_1$ | |
| 100 cm³ | 0 cm³ | 20.9 |
| 75 cm³ | 25 cm³ | 17.1 |
| 50 cm³ | 50 cm³ | 15.7 |
| 25 cm³ | 75 cm³ | 16.4 |
| 0 cm³ | 100 cm³ | 17.1 |

The solutions obtained starting with the two types of compounds described produce films which spread very rapidly but which are fragile and have rather low foam-forming properties.

Drainage or run-off of the aqueous solutions must be sufficiently rapid to compensate for the destruction of the film by the fire and at the same time be sufficiently slow and progressive to extend throughout the extinction process and to avoid the formation of large continuous sheets of dense liquid whose weight would overcome the interfacial tensions.

The applicants have determined that the addition of a salt of a polyfluorinated acid and a diamine:

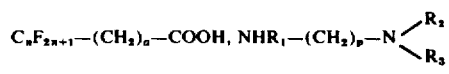

$$C_nF_{2n+1}-(CH_2)_a-COOH, NHR_1-(CH_2)_p-N(R_2)(R_3)$$

substantially increases the foaming properties of the previously described binary i.e. two element, combination. For example, Table 2 shows that the foaming power increases continuously in solutions of 0.5% by weight of fluorinated products having increasing proportions of the diamine salts $$C_6F_{13}C_2H_4\,COOH, NH_2 - (CH_2)_3 - N(CH_3)_2$$

TABLE 2

| Ampholyte fluorinated compound $I_1$ Volume of 0.5% solution in $cm^3$ | Non-ionic fluorinated compound $II_1$ Volume of 0.5% solution in $cm^3$ | Salt of fluorinated acid and of diamine Volume of 0.5% solution in $cm^3$ | Foaming power in $cm^3$ |
|---|---|---|---|
| 590 | 410 | 0 | 470 |
| 540 | 360 | 100 | 420 |
| 640 | 160 | 200 | 520 |
| 480 | 120 | 400 | 620 |

The foaming power, determined according to the ISO TC 91 – 182 F standard, corresponds to the volume of foam developed when, under specified conditions, 500cc of an aqueous solution of the surface-active mixture are poured with the aid of a calibrated funnel into 100cc of the same solution placed at the bottom of a calibrated two litter vessel. The quality of the foam obtained is defined by the speed at which it drains off which is determined by the time necessary to collect at the bottom of the graduated vessel a volume of solution equal to one-quarter the volume of foam initially introduced. For the results to be comparable, the foam must be brought to a constant level or degree of expansion corresponding to an 8 to 10 ratio of the volume of foam to the volume of solution used for its preparation.

The efficacy of a fire-extinguishing solution is also dependent on the speed of spreading of the film and on its cohesion. A good film is one which spreads at a speed of 30 to 40 square centimeters per second on cyclohexane and which resists mechanical disturbance such as bubbles of vapor emanating from the subjacent liquid or turbulent motion without being permanently torn.

The speed of spreading of the film is an important characteristic and is evaluated in the following manner: A crystallizer of 145mm diameter is half filled with cyclohexane. Five (5) drops of a 0.5% solution of the mixture of fluorinated surface-active materials are deposited in the center of the cyclohexane. The difference in light reflecting power makes it possible to follow the spread of the fluorinated film and thus to measure the time necessary for coverage of the entire surface of the cyclohexane.

Two methods have already been proposed to improve the spreading speeds of film forming fluorinated surface-active compounds. According to French patent No. 2,009,827 a water soluble hydrocarbon surface-active compound is added to the fluorinated surface active material. According to British patent BP 1,230,980, a hydrocarbon surface-active agent, preferably chosen from among the quaternary ammonium salts is added instead. The applicants have found that the salts of polyfluorinated acids and diamines hereinabove described also act to increase the film spreading speed as is shown in Table 3 for tests carried out with mixtures prepared from the products used previously in the tests for which results were shown in Tables 1 and 2.

TABLE 3

| Volumes of aqueous 0.5% solutions in $cm^3$ Ampholyte fluorinated compound $I_1$ | Non-ionic fluorinated compound $II_1$ | Salt of fluorinated acid and of diamine | Spreading speed in seconds |
|---|---|---|---|
| 30 | 20 | 0 | 13 |
| 28.8 | 19.2 | 2 | 18 |
| 28.2 | 18.8 | 3 | 8 |
| 27.6 | 18.4 | 4 | 10 |
| 27 | 18 | 5 | 7 |
| 24 | 16 | 10 | 6 |
| 18 | 12 | 20 | 4 |
| 12 | 8 | 30 | 4 |
| 6 | 4 | 40 | 3 |
| 0 | 0 | 50 | 2 |

When the experiment is carried out with one of these three component mixtures, it is observed after an initial spreading period that the film has a tendency to shrink. If the film is ruptured with a stirrer, the edges do not weld back together and the film is no longer complete. Observation of the fringes in white light shows that in this situation the film is extremely thin along its edges and does not have a uniform thickness over its whole surface.

The applicants have found to their surprise that this shortcoming disappears when the tertiary amine function of the salts $$C_n F_{2n+1} - (CH_2)_a - COOH, NHR_1 - (CH_2)_p - N (R_2 R_3)$$

is quarternized with the help of a lactone

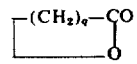

to produce a salt of the formula:

$$C_n F_{2n+1} - (CH_2)_a - COO^-, N^+H_2R_1 - (CH_2)_p - N^+R_2R_3 - (CH_2)_q - COO^- \quad (IV)$$

Not only are the spreading speed and foaming power increased as compared to the results obtained with the binary mixtures of the compounds of Formula I and II alone, but in addition a uniform film which cannot be torn and which is extremely stable results.

The film-forming power $PF_t$ of the films is characterized by the ratio of the evaporation speed of the solvent measured with and without the fluorinated film under experimental conditions otherwise identical:

$$PF_t = \frac{\text{evaporation speed in presence of the fluorinated film}}{\text{evaporation speed of the solvent}}$$

This index corresponds to the time interval occuring between the beginning the formation of the film and the time of measurement.

It is also possible to measure the film forming power of the solutions by comparison with cyclohexane. For this test, which is more severe than the preceeding one, the same material as in the determination of the spreading speed is used. The formation of the film is obtained by spreading, with the aid of a syringe, 0.1 cc of surface-active solution over the entire surface of the hydrocarbon. The results are expressed in the same way as above.

The fire-extinguishing compounds of the invention can be measured for the impermeability to flame and for the resistance to reignition by the following tests:

Impermeability To the Flame

80cc of cyclohexane are placed in a flat bottomed stainless steel vessel having 150 millimeters in diameter and 32 millimeters in height. 0.1cc of the surface-active solution are deposited at the center of the surface of the cyclohexane and thirty seconds later an additional 0.15cc of the solution are distributed with help of a syringe over the entire surface of the sample. After one minute a microflame is placed in the center of the vessel, 25 millimeters from the surface of the cyclohexane, and one measures the elapsed time prior to ignition or flaming of the hydrocarbon.

Resistance to Reignition

This test measures the behavior of the film vis-a-vis the fire, namely fire retardant action by generation of water vapor and protective action by self-spreading. The test is carried out after the completion of the preceeding test by bringing the microflame into contact with the surface at a location on the wall of the vessel. The time is measured from when the cyclohexane begins to burn until the region of combustion spreads to one half the surface of the sample.

Applicant has determined that in the case of compositions having as a base mixtures of the fluorinated ampholyte surfactant of Formula I, the non-ionic fluorinated surfactant of Formula II, and the quaternized fluorinated diamine salt of Formula IV, the spreading speed of the film has two maximum values which are functions of the proportions of the constituents.

This completely unexpected variation in the speed of spreading as a function of the composition of the mixtures, for a given total concentration of fluorinated surface-active material, shows the existence of a region of concentrations which produce particularly efficacious compositions.

The results gathered together in Table 4 below show that, for solutions composed of mixtures of products $I_1$, $II_1$ and $IV_1$ these concentrations are located between 36 and 55.2 percent for the ampholyte composition of Formula $I_1$, between 24 and 36.8% for the non-ionic compound of Formula $II_1$, between 8 and 40% for the diamine salt of Formula $IV_1$ quaternized with propiolactone.

$$C_6F_{13}C_2H_4COO^-, NH^+_3 - (CH_2)_3N^+(CH_3)_2 \quad (IV_1)$$
$$CH_2-CH_2-COO^-$$

TABLE 4

| Volumes of aqueous 0.5% solutions in cm³ Ampholyte fluorinated constituent $I_1$ | Non-ionic fluorinated constituent $II_1$ | Quaternized diamine salt $IV_1$ | Spreading speed in seconds |
|---|---|---|---|
| 30 | 20 | 0 | 12 |
| 29.4 | 19.6 | 1 | 8 |
| 28.8 | 19.2 | 2 | 30 |
| 28.2 | 18.8 | 3 | 12 |
| 27.6 | 18.4 | 4 | 6 |
| 27 | 18 | 5 | 5 |
| 24 | 16 | 10 | 5 |
| 18 | 12 | 20 | 5.5 |
| 12 | 8 | 30 | 30 |
| 6 | 4 | 40 | no spreading |

The extent of the most advantageous region diminishes with increase of the ratio by weight of the fluorinated ampholyte constituent to the non-ionic fluorinated constituent. When the value of this ratio is increased from 1.5 to 4, the limits of the most advantageous concentrations take on the following values:

| (for a total concentration in fluorinated products of 0.5%) | |
|---|---|
| fluorinated ampholyte constituent | 64–73% |
| non-ionic fluorinated constituent | 16–19% |
| quaternized diamine salts | 8–20% |

The total 0.5% concentration used in the tests above described by the applicant does not constitute a lower limit, and good film forming properties can be obtained with aqueous solutions having a total of 0.1% to 2% of fluorinated mixture.

In the use of the fire extinguishing compositions of this invention it is often advantageous from an economic point of view to use the three compounds $I_1$, $II_1$ and $IV_1$ derived from the same fluorinated acid:

$$C_nF_{2n+1} - (CH_2)_a - COOH.$$

It is however likewise possible without adverse affect on the results obtained, to use mixtures of the derivatives I, II and III or IV obtained from different fluorinated acids.

Examples 1–4 give the mode of preparation of fluorinated products used in preparing fire extinguishing compositions according to this invention. Examples 5–12 illustrate these compositions in examplary manner and examples 13, 14 and 15 illustrate their film-forming properties and their effectiveness in extinguishing fires and slowing the evaporation of hydrocarbons.

EXAMPLE I

The fluorinated ampholyte surface-active agent $$C_8F_{17} - C_2H_4 - CONH - (CH_2)_3N^+(CH_3)_2-CH_{-2}-CH_2-COO^-$$

is prepared by addition of the $\beta$-propriolactone or of acrylic acid to the polyfluoroamine $$C_8F_{17}C_2H_4CONH-(CH_2)_3N\begin{matrix}CH_3\\CH_3\end{matrix}$$

EXAMPLE 2

150cc of xylene, 300 grams (0.755mole) of the acid $C_6F_{13}C_2H_4$ COOH, 268 grams (0.755 mole) of the polyethoxylated alkylated alcohol $HO(CH_2—CH_2—O)_7CH_3$ sold by Produits Chimiques Ugine Kuhlmann under the name EMKANOL M350, and 0.74 grams of concentrated sulfuric acid, were introduced into a one liter pyrex reactor equipped with a stirrer, tube for the introduction of nitrogen, and an extraction device of the DEAN and STARCK type surmounted with an ascending refrigerant. The mixture was heated with reflux and subjected to a slow scavenging with nitrogen, and after four hours the theoretical quantity of water was recovered. The xylenic solution was clarified by refluxing for a quarter of an hour in the presence of 10 grams of activated carbon. After filtration and evaporation of the solvent, 525 grams of a viscous yellow liquid were recovered having the formula $$C_6F_{13}C_2H_4\ COO\ (CH_2—CH_2—O)_7\ CH_3$$

with a yield of 95%.

EXAMPLE 3

39.2 grams (1/10 mole of $C_6F_{13}C_2H_4$ COOH acid were dissolved in 80cc of ethyl acetate and neutralized with 10.2 grams (1/10 mole) of N-dimethylpropanediamine 1-3. Infrared analysis of the product obtained after evaporation of the solvent confirmed the formation of a salt of the diamine on the primary amine function, giving the derivative $$C_6F_{13}C_2H_4\ COO^-NH_3^+(CH_2)_3\ N\begin{matrix}CH_3\\CH_3\end{matrix}$$

The compound was quaternized with β-propiolactone by addition to the reaction mixture of 7.2 grams (1/10 mole) of β-propiolactone and by maintaining this mix at a temperature in the vicinity of 0°C. After a contact time of 2 hours, the solvent was removed and the compound $$C_6F_{13}C_2H_4COO^-\quad NH_3^+\quad —\quad (CH_2)_3\quad —N^+(CH_3)_2—CH_2—CH_2—COO^-$$

the structure of which was confirmed by infrared spectometry, was recovered.

EXAMPLE 4

21.4 grams of polyflurosulphonic acid $C_6F_{13}C_2H_4SO_3H$ of 95% purity were dissolved in 150cc of ethyl acetate. 7.45 grams of triethanolamine were added. The precipitated sulfonate was isolated by filtration on a filter crucible and washed twice with 50cc of ethyl acetate. 24 grams of a white product corresponding to the following formula $$C_6F_{13}C_2H_4SO_3^-,\ N^+H\ —\ (C_2H_4OH)_3$$

were obtained.

EXAMPLE 5

The following mixture was produced including in addition 0.3% of isopropyl alcohol.

| | |
|---|---|
| $C_8F_{17}C_2H_4$ $CONH—(CH_2)_3N(CH_3)_2CH_2—CH_2—COO^-$ | 68% by weight |
| $C_6F_{13}C_2H_4$ COOH $(CH_2—CH_2—O)_7CH_3$ | 18% by weight |
| $C_6F_{13}C_2H_4$ $COO—,\ NH_3^+—(CH_2)_3—N^+(CH_3)_2 — CH_2 — CH_2 — COO^-$ | 14% by weight |

The presence of the isopropanol makes it possible to prepare concentrated mixtures of 400 grams per liter which were diluted to a suitable ratio at the time of use. All of the solutions hereinafter considered thus contain the same quantity of this alcohol. The properties of the solution diluted down to 0.5% are as follows:

| | |
|---|---|
| foaming power: | 400cc |
| pH: | 5.6 |
| dynamic viscosity: | 10.5 mPo at 23°C |
| surface tension: | 14.8 dynes/cm at 21°C |
| interfaced tension with cyclohexane: | 5.9 dynes/cm at 21°C |

Since cyclohexane at this temperature possesses a surface tension of 25.5 dyness/cm, this solution has a distinct positive spreading coefficient of +4.8.

| | | | |
|---|---|---|---|
| spreading speed: | 7 seconds | | |
| drainage speed: | 2 minutes 45 seconds | | |
| Film forming power | After 1 Minute | After 10 Minutes | After 15 Minutes |
| of the foam with reference to high test gasoline | 0.22 | | 0.26 |
| of the solution with reference to cyclohexane | 0.18 | 0.20 | 0.41 |
| impermeability to flame: | greater than 38 mm. | | |
| resistance to flame return: | 12.5 seconds (reignition) time | | |

It will be noted that this extinguishing composition makes it possible to simultaneously obtain good foaming capabilities, high spreading speed and drainage speed, high film-forming properties, high impermeability to flame and high resistance to flame return or low reignition characteristics.

EXAMPLE 6

The following ternary mixture was produced

| | |
|---|---|
| $C_8F_{17}C_2H_4$ $COHN—(CH_2)_3—N\ (CH_3)_2 —CH_2—CH_2—COO^-$ | 68% by weight |
| $C_6F_{13}C_2H_4COO\ (CH_2—CH_2—O)_7CH_3$ | 18% by weight |
| $C_6F_{13}C_2H_4COO^-NH_3^+—(CH_2)_3—N(CH_3)_2$ | 14% by weight |

A 0.5 percent aqueous solution of fluorinated product including 0.3% isopropyl alcohol was prepared from this mixture.

The characteristics of this solution were as follows:

| | | | |
|---|---|---|---|
| foaming power: | 360cc | | |
| pH: | 7.65 | | |
| dynamic viscosity: | 13.2mPo at 23°C | | |
| spreading speed: | 9 seconds | | |
| drainage speed: | 9 minutes | | |
| Film forming power | After 1 Minute | After 10 Minutes | After 15 Minutes |
| of the foam with reference to high test gasoline | 0.66 | 0.20 | 0.23 |
| of the solution with reference to cyclohexane | 0.23 | 0.45 | 0.45 |
| impermeability to flame: | 10 minutes | | |
| resistance to cyclohexane | 11 seconds | | |

It will be noted that this fire-extinguishing composition, which includes as a third ingredient a non-quaternized salt of diamine, produces results inferior to those obtained in example 5, particularly with regard to impermeability to the flame, film-forming power, and spreading capacities.

EXAMPLE 7

The following mixture was prepared:

| | |
|---|---|
| $C_8F_{17}C_2H_4CONH-(CH_2)_3N^+(CH_3)_2CH_2-CH_2-COO^-$ | 55% by weight |
| $C_8F_{13}C_2H_4COO(CH_2-CH_2-O)_7CH_3$ | 37% by weight |
| $C_8F_{13}C_2H_4COO^-, NH_3^+-(CH_2)_3N^+(CH_3)_2CH_2-CH_2-COO^-$ | 8% by weight |

This mixture was put into an 0.5% aqueous solution. The solution possessed the following properties:

| | |
|---|---|
| foaming power: | 340cc |
| pH: | 5.2 |
| dyanmic viscosity: | 11.5 mPo at 23°C |
| spreading speed: | 6 seconds (same value after one month) |

| Film forming power | After 1 Minute | After 10 Minutes | After 15 Minutes |
|---|---|---|---|
| of the foam with respect to high-octane gasoline | 0.27 | | 0.26 |
| of the solution with respect to cyclohexane | 0.13 | 0.18 | 0.32 |

| | |
|---|---|
| impermeability to flame: | 12 minutes |
| resistance to reignition: | 13 seconds |

EXAMPLE 8

From the following mixture:

| | |
|---|---|
| $C_8F_{17}C_2H_4CONH-(CH_2)_3N^+(CH_3)_2CH_2-CH_2-COO^-$ | 36% by weight |
| $C_8F_{13}C_2H_4COO(CH_2-CH_2-O)_7CH_3$ | 24% by weight |
| $C_8F_{13}C_2H_4COO^-, NH_3^+(CH_2)_3N(CH_3)_2$ | 40% by weight |

an 0.5% aqueous solution was prepared having the following properties:

| | |
|---|---|
| foaming power: | 640 cc |
| pH: | 8.35 |
| dynamic viscosity: | 10.2mPo at 23°C |
| spreading speed: | 4.5 seconds (40 seconds after 30 days) |
| drainage speed: | 3 minutes (solution 30 days) |

| Film forming power | After 1 Minute | After 10 Minutes | After 15 Minutes |
|---|---|---|---|
| of the foam with respect to high-octane gasoline | 0.25 | | 0.15 |
| of the solution with respect to cyclohexane | 0.26 | 0.84 | 1.0 |

| | |
|---|---|
| impermeability to flame: | 12 minutes |
| resistance to reignition: | 12 seconds |

EXAMPLE 9

The following mixture was prepared:

| | |
|---|---|
| $C_8F_{17}C_2H_4CONH(CH_2)_3N^+(CH_3)_2CH_2-CH_2-COO^-$ | 54% by weight |
| $C_8F_{13}C_2H_4COO-(CH_2-CH_2-O)_7CH_3$ | 36% by weight |
| $C_8F_{13}C_2H_4COO^-NH_3^+-(CH_2)N^+(CH_3)_2CH_2CH_2COO^-$ | 10% by weight |

This mixture was put into an 0.5% aqueous solution. The solution possessed the following properties:

| | |
|---|---|
| foaming power: | 390cc |
| pH: | 4.0 |
| dynamic viscosity: | 10.25mPo at 23°C |
| surface tension: | 15.6 dynes/cm at 21°C |
| interfacial tension with cyclohexane: | +4.4 dynes/cm |
| spreading speed: | 4 seconds |
| drainage speed: | 2 minutes 55 seconds |

| Film forming power | After 1 Minute | After 10 Minutes | After 15 Minutes |
|---|---|---|---|
| of the foam with respect to | | | |

-continued

| | | | |
|---|---|---|---|
| high-octane gasoline | 0.25 | | 0.17 |
| of the solution with respect to cyclohexane | 0.18 | 0.58 | |

| | |
|---|---|
| impermeability to flame: | > 15 minutes |
| resistance to reignition: | 15.5 seconds |

EXAMPLE 10

The following mixture was prepared:

| | |
|---|---|
| $C_8F_{17}C_2H_4CONH(CH_2)_3N^+CH_2-CH_2-COO^-$ | 62% by weight |
| $C_8F_{13}C_2H_4COO(CH_2-CH_2-O)_7CH_3$ | 30% by weight |
| $C_8F_{13}C_2H_4COO^-, N^+H_3(CH_2)_3N^+(CH_3)CH_2-CH_2-COO^-$ | 8% by weight |

This mixture was put into an 0.5% aqueous solution. The solution possessed the following properties:

| | |
|---|---|
| foaming power: | 450cc |
| pH: | 4.05 |
| dynamic viscosity: | 10.2 mPo at 23°C |
| spreading speed: | 4 seconds |
| drainage speed: | 4 minutes |

| Film forming power | After 1 Minute | After 10 Minutes | After 15 Minutes |
|---|---|---|---|
| of the foam with respect to high-octane gasoline | 0.28 | 0.29 | 0.30 |
| of the solution with respect to cyclohexane | 0.18 | 0.37 | 0.45 |

| | |
|---|---|
| impermeability to flame: | >10 minutes |
| resistance to reignition: | 12 seconds |

EXAMPLE 11

The following mixture was produced:

| | |
|---|---|
| $C_8F_{17}C_2H_4CONH-(CH_2)_3N^+(CH_3)_2CH_2-CH_2-COO^-$ | 60% by weight |
| $C_8F_{13}C_2H_4COO(CH_2-CH_2-O)_7CH_3$ | 40% by weight |

An 0.5% solution of this mixture produced the following properties:

| | |
|---|---|
| foaming power: | 130cc |
| pH: | 4.95 |
| surface tension: | 17.7 dynes/cm |
| spreading speed: | 13 seconds |

This example shows that poorer results are obtained only when there is used a mixture of the two first constituents of the extinguishing compositions according to the invention.

EXAMPLE 12

The following mixture was prepared:

| | |
|---|---|
| $C_8F_{17}C_2H_4CONH-(CH_2)_3N^+(CH_3)_2CH_2-CH_2-COO^-$ | 83% by weight |
| $C_8F_{13}C_2H_4SO_3^-, N^+H(CH_2H_4OH)_3$ | 17% by weight |

This mixture was put into an 0.5% aqueous solution. The solution possessed the following properties:

| | |
|---|---|
| foaming power: | 100cc |
| pH: | 6.15 |
| dynamic viscosity: | 34.5 mPo at 23°C |
| surface tension: | 14.3 dynes/cm |
| spreading speed: | 35 seconds |
| drainage speed: | >30 minutes |

EXAMPLE 13

0.36% and 0.10% solutions of the mixture described in EXAMPLE 7 were prepared and the film forming properties of the solutions with reference to cyclohexane were determined.

| Concentration | After 1 Minute | After 10 Minutes | After 15 Minutes |
|---|---|---|---|
| 0.36 % | 0.19 | 0.27 | 0.46 |
| 0.10 % | 0.32 | 0.70 | 0.93 |

These results show that with the composition of EXAMPLE 7 one should not go to total concentrations of fluorinated products below 0.1%, if it is desired to retain a good film forming property.

EXAMPLE 14

Extinction of a type 233Bl fire (tub 3 meters in diameter having 7 square meter surface and containing 233 liters of domestic fuel oil) was attained in 22 seconds by use of 0.22% solution of the mixture described in EXAMPLE 10. The fire extinguisher employed was of the type producing a waterspray and the fire was attacked after one minute of burning.

EXAMPLE 15

Three one-liter beakers A, B, and C each 110 millimeters in diameter were partly filled with 900 cc of cyclohexane. In beakers B and C on the surface of the cyclohexane, 0.1cc of the film-forming solutions described in EXAMPLE 5 and 10 respectively were placed. Beaker A served as a reference and the rate of evaporation of the hydrocarbon was measured in all three beakers. The results obtained are summarized in table 5 and show the power of the products of the invention to retard evaporation of hydrocarbons

| Time | A | B | C |
|---|---|---|---|
| 3 days | 17.8% | 3.3% | 3.9% |
| 5 days | 30.4% | 5.5% | 6.1% |
| 7 days | 42.3% | 8.3% | 8.3% |

We claim:

1. A surface-active fluorinated composition characterized by the association therein of from 35% to about 60% of at least one surface-active ampholyte compound of the formula

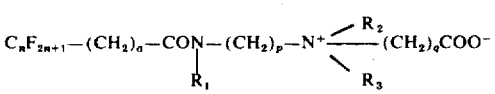

wherein $n$ is an integer between 1 and 20, a is a number between 2 and 10, $R_1$ is an atom of hydrogen or an alkyl radical containing from 1 to 6 atoms of carbon, $R_2$ and $R_3$ are alkyl radicals containing from 1 to 3 atoms of carbon, at least one of which is the methyl radical and $p$ and $q$ are integers between 0 and 10; from about 20% to about 40% of at least one surface-active fluorinated non-ionic compound of the formula $$C_nF_{2n+1} - (CH_2)_a - CO-O-(CH_2-CH_2-O)_mR_4$$

wherein $n$ and a have the same meaning as above, $m$ is an integer between 1 and 20 and $R_4$ is an alkyl radical containing from 1 to 6 atoms of carbon; and from about 8% to about 40% of at least one amine salt compound of the formula

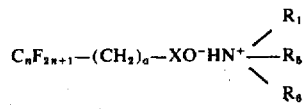

wherein X is the group CO or $SO_2$, $R_1$, $R_5$ and $R_6$ may be hydrogen atoms, alkyl radicals containing from 1 to 6 atoms of carbon, or the group

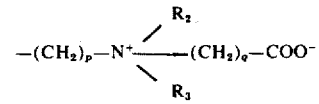

in which $R_2$, $R_3$, $p$ and $q$ have the values given above.

2. A method of extinguishing fires which comprises applying thereto an effective amount of an aqueous solution, including from 0.1 to 2% of the surface-active fluorinated compositions of claim 1.

3. A method of reducing the surface tension of a liquid which comprises adding thereto an effective amount of at least one surface-active fluorinated composition of claim 1.

4. A method of retarding the evaporation of a volatile organic liquid which comprises applying thereto an effective amount of at least one surface-active fluorinated composition of claim 1.

5. A method of extinguishing hydrocarbon fires which comprises applying thereto an effective amount of a protein containing or protein-type solution including from 0.1 to 2% of the surface-active fluorinated compositions of claim 1 and from 2 to 6% of protein.

6. A surface-active fluorinated composition of claim 1 in which the surface-active ampholyte compound is the derivative $C_8F_{17}C_2H_4CONH-(CH_2)_3N^+(CH_3)_2CH_2-CH_2-COO^-$ and the non-ionic compound is the derivative $$C_6F_{13}-C_2H_4COO-(CH_2-CH_2-O)_7CH_3$$

and the amine salt compound is the derivative $C_6F_{13}-C_2H_4-COO^-, N^+H_3-(CH_2)_3-N^+(CH_3)_2-CH_2-CH_2-COO^-.$

7. A method of extinguishing fires which comprises applying thereto an effective amount of an aqueous solution containing from about 0.1 to 2% of the surface-active fluorinated composition of claim 6.

8. A method of reducing the surface tension of a liquid which comprises adding thereto an effective amount of the surface-active fluorinated composition of claim 6.

9. A method of retarding the evaporation of a volatile organic liquid which comprises applying thereto an effective amount of the surface-active fluorinated composition of claim 6.

10. A method of extinguishing hydrocarbon fires which comprises applying thereto an effective amount of a protein containing or protein-type solution including from 0.1 to 2% of the surface-active fluorinated compositions of claim 6 and from 2 to 6% of protein.

11. A surface-active fluorinated composition characterized by the association therein of from 35% to about 60% of at least one surface-active ampholyte compound of the formula

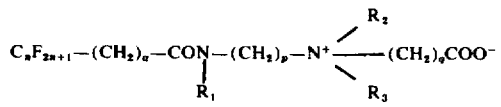

wherein $n$ is an integer between 1 and 20, a is a number between 2 and 10, $R_1$ is an atom of hydrogen or an alkyl radical containing from 1 to 6 atoms of carbon, $R_2$ and $R_3$ are alkyl radicals containing from 1 to 3 atoms of carbon, at least one of which is the methyl radical and $p$ and $q$ are integers between 0 and 10; from about 20% to about 40% of at least one surface-active fluorinated non-ionic compound of the formula $$C_nF_{2n+1} - (CH_2)_a - CO - O(CH_2 - CH_2 - O)_mR_4$$

wherein $n$ and a have the same meaning as above, $m$ is an integer between 1 and 20 and $R_4$ is an alkyl radical containing from 1 to 6 atoms of carbon; and from about 8% to about 40% of at least one diamine salt compound of the formula

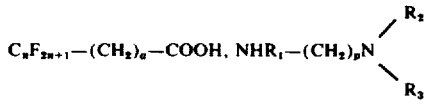

wherein $n$, $a$, $p$, $R_1$, $R_2$ and $R_3$ have the same meaning as above, or at least one amine salt compound of the formula

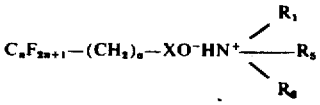

wherein $n$ and a have the same meaning as above, X is the group CO or $SO_2$, $R_1$, $R_5$ and $R_6$ may be hydrogen atoms, alkyl radicals containing from 1 to 6 atoms of carbon, hydroxyalkyl radicals containing from 1 to 3 atoms of carbon, or the group

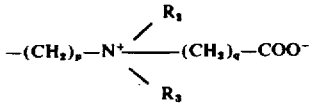

in which $R_2$, $R_3$, $p$ and $q$ have the values given above

12. A method of extinguishing fires which comprises applying thereto an effective amount of an aqueous solution, including from 0.1 to 2% of at least one surface-active fluorinated composition of claim 11.

13. A method of reducing the surface tension of a liquid which comprises adding thereto an effective amount of at least one surface-active fluorinated composition of claim 11.

14. A method of retarding the evaporation of a volatile organic liquid which comprises applying thereto an effective amount of at least one surface-active fluorinated composition of claim 11.

15. A method of extinguishing hydrocarbon fires which comprises applying thereto an effective amount of a protein containing or protein-type solution including from 0.1 to 2% of at least one surface-active fluorinated composition of claim 11 and from 2 to 6% of protein.

16. A surface-active fluorinated composition of claim 11 in which the surface-active ampholyte compound is the derivative $$C_8F_{17}C_2H_4CONH - (CH_2)_3N^+ (CH_3)_2 CH_2 - CH_2 - COO^-$$

and the non-ionic compound is the derivative $$C_6F_{13} - C_2H_4 COO - (CH_2 - CH_2 - O)_7CH_3$$

and the amine salt compound is the derivative $$C_6F_{13} - C_2H_4 - COO^-, \quad N^+H_3 - (CH_2)_3 - N^+(CH_3)_2 - CH_2 - CH_2 - COO^-.$$

17. A method of extinguishing fires which comprises applying thereto an effective amount of an aqueous solution containing from about 0.1 to 2% of the surface-active fluorinated composition of claim 16.

18. A method of reducing the surface tension of a liquid which comprises adding thereto an effective amount of the surface-active fluorinated composition of claim 16.

19. A method of retarding the evaporation of a volatile organic liquid which comprises applying thereto an effective amount of the surface-active fluorinated composition of claim 16.

20. A method of extinguishing hydrocarbon fires which comprises applying thereto an effective amount of a protein containing or protein-type solution including from 0.1 to 2% of the surface-active fluorinated composition of claim 16 and from 2 to 6% of protein.

* * * * *

UNITED STATES PATENT AND TRADEMARK OFFICE

CERTIFICATE OF CORRECTION

PATENT NO. : 3,941,705

DATED : March 2, 1976

INVENTOR(S) : LOUIS FOULLETIER ET AL.

It is certified that error appears in the above-identified patent and that said Letters Patent are hereby corrected as shown below:

Column 1, line 61, "conequently" should read --consequently--.

Column 2, line 54, "anion-ionic" should read --a non-ionic--; line 57, the right-hand moiety should read -- - $(CH_2 - CH_2 - O)_m R_4$--.

Column 5, line 33, "litter" should read --liter--.

Column 7, line 2, "beginning the" should read --beginning of the--.

Column 8, line 56, the right-hand moiety should read -- $-CH_2-CH_2-COO^-$--.

Column 10, lines 27-28, "(reignition) time" should read --(reignition time)--; line 61, "cyclohexane" should read --reignition:--.

Column 11, line 15, "dyanmic" should read --dynamic--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*